United States Patent [19]

Meisenburg

[11] Patent Number: 4,872,860

[45] Date of Patent: Oct. 10, 1989

[54] SACRIFICIAL ANODE FOR MARINE PROPULSION UNITS

[75] Inventor: Gary L. Meisenburg, Fond du Lac, Wis.

[73] Assignee: Brunswick Corporation, Skokie, Ill.

[21] Appl. No.: 197,710

[22] Filed: May 23, 1988

[51] Int. Cl.[4] ..... C23F 13/00

[52] U.S. Cl. ..... 440/113; 204/196; 440/900; 440/61

[58] Field of Search ..... 440/113, 900, 61; 204/196, 197

[56] References Cited

U.S. PATENT DOCUMENTS

| | | | |
|---|---|---|---|
| 3,060,259 | 10/1962 | Flower et al. | 204/196 |
| 3,098,027 | 7/1963 | Flower | 204/196 |
| 4,267,029 | 5/1981 | Massarsky | 204/196 |
| 4,342,634 | 8/1982 | Haasl et al. | 204/197 |

*Primary Examiner*—Sherman D. Basinger
*Assistant Examiner*—Thomas J. Brahan
*Attorney, Agent, or Firm*—Andrus, Sceales, Starke & Sawall

[57] ABSTRACT

A sacrificial anode (19, 47, 55, 61) is disposed in association with the trim cylinder unit (12) of a marine propulsion device and is positioned in the previously unused area between the aft cylinder (13) end and the rodeye (16) or the like on the piston rod (15) end. More specifically, the anode is in the form of an elongated generally cylindrical member of a diameter approximating that of the trim cylinder to provide improved mass characteristics, and is deeply grooved (21) to thus provide ribs (22) which enhance the working surface area. The anode may be attached to an extended pilot member (23, 45) which is suitably secured within the aft end of the trim cylinder. It is contemplated that a cover (35) may be utilized in conjunction with the anode to improve the aesthetic appearance of the affected area, while permitting water flow through the anode. In one embodiment, a unitary anode (19) is provided with a radial slot (33), which permits the anode to be positioned over the trim cylinder rod (15). In another embodiment (FIGS. 9–11), the anode (47) is formed as two half cylinders (48). In yet anothr embodiment (FIGS. 12–13), the anode (55) is formed as two segments (56), each having staggered puzzle-like configurations which are interfit. Depending on the anode type, the anode may be secured to the pilot member by longitudinal bolts (31, 60) or by a rib and groove connection (51, 53). Alternately (FIG. 14), the anode may be secured directly on the trim cylinder piston rod shaft. In addition, the anode cover may be secured to the anode itself or to the trim cylinder by a snal-on arrangement.

16 Claims, 4 Drawing Sheets

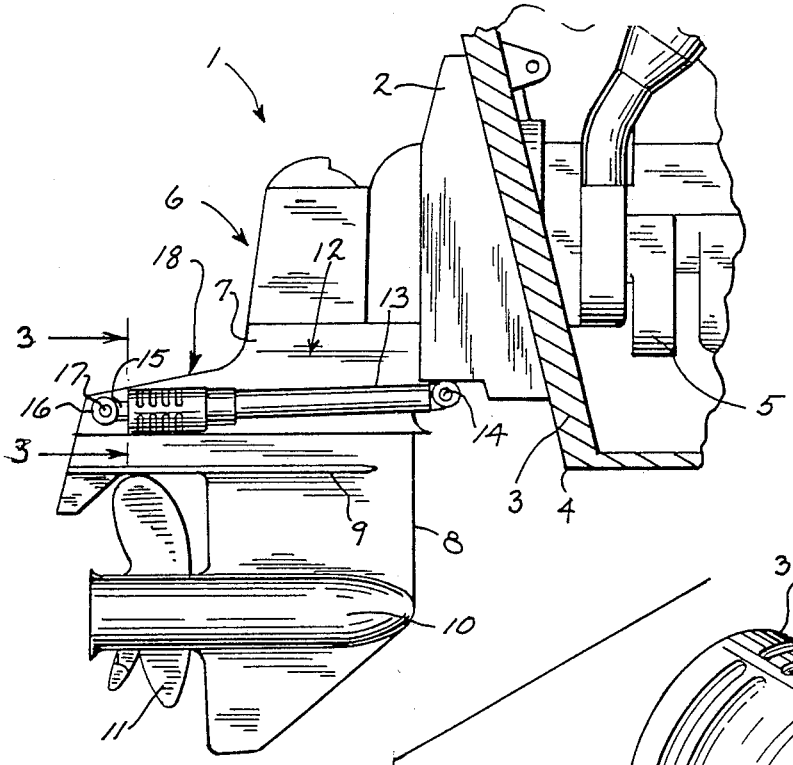
FIG. 1
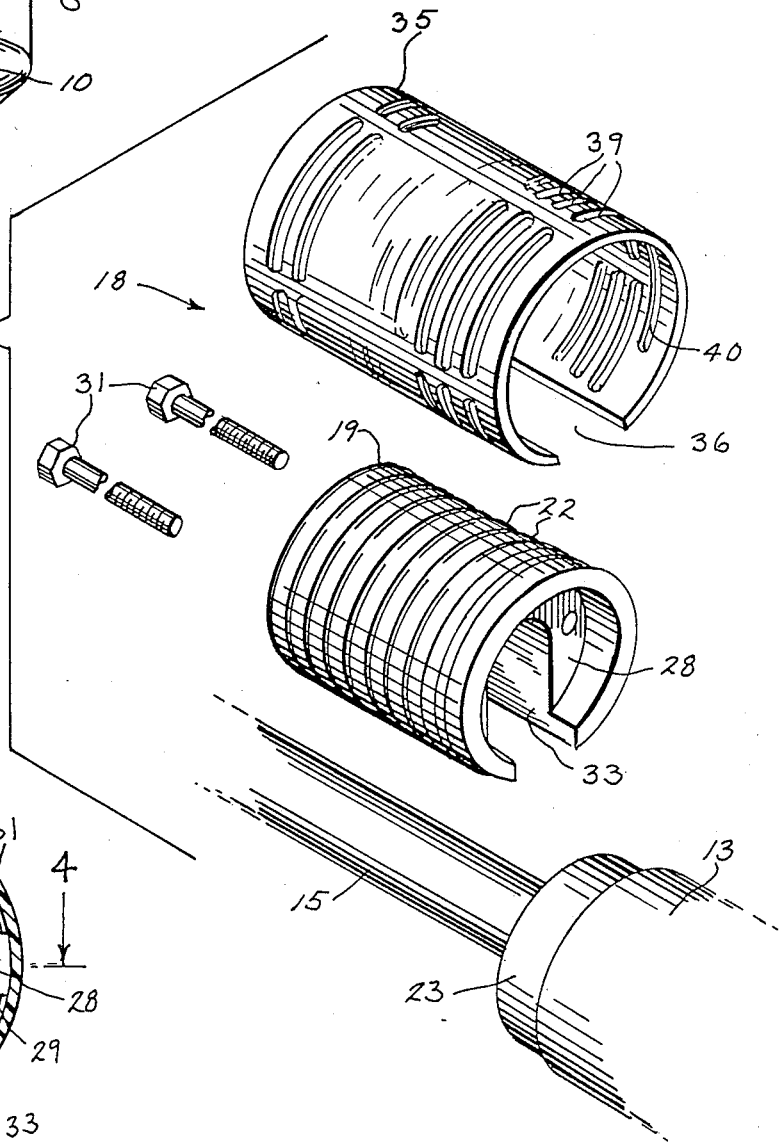
FIG. 2
FIG. 3
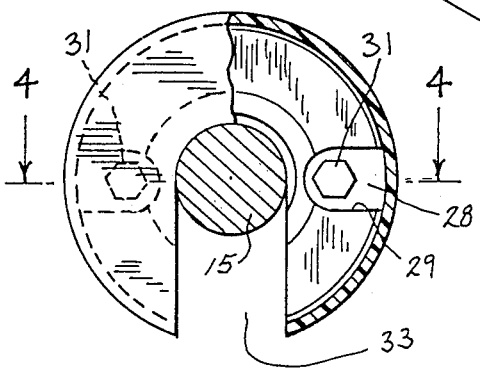

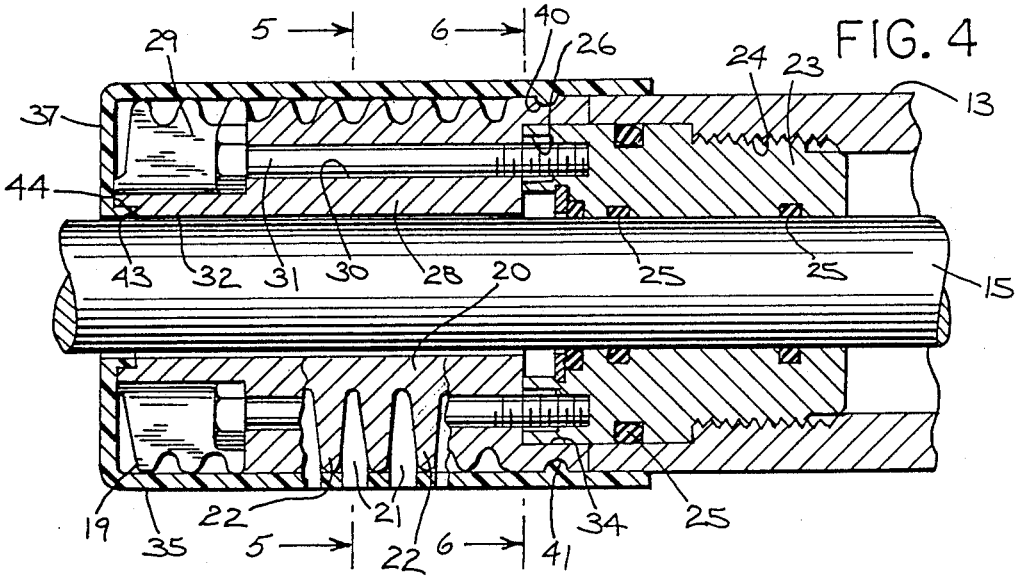
FIG. 4
FIG. 5
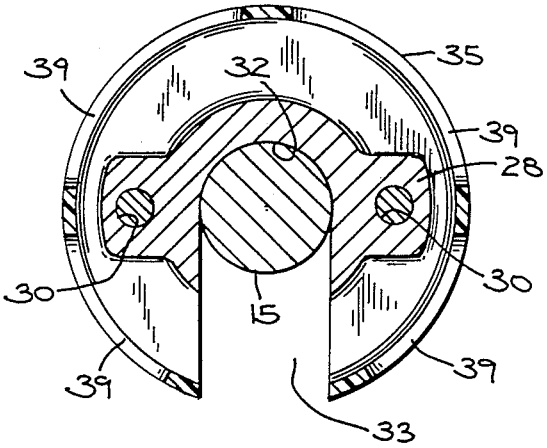
FIG. 6
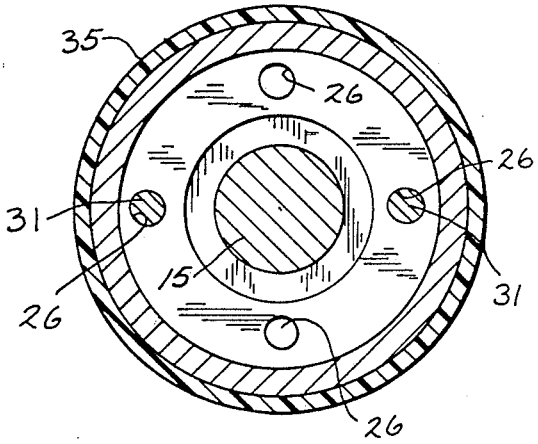
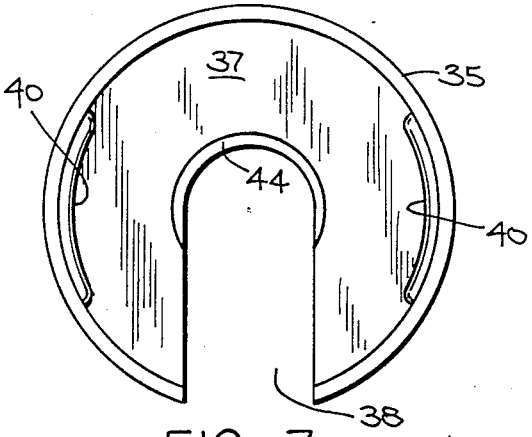
FIG. 7
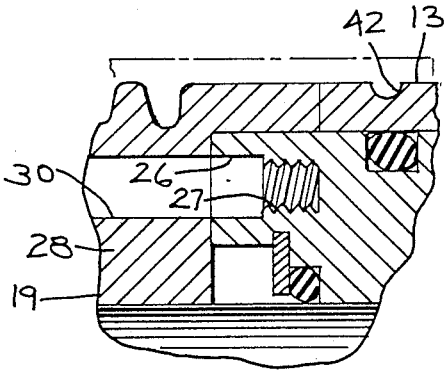
FIG. 8

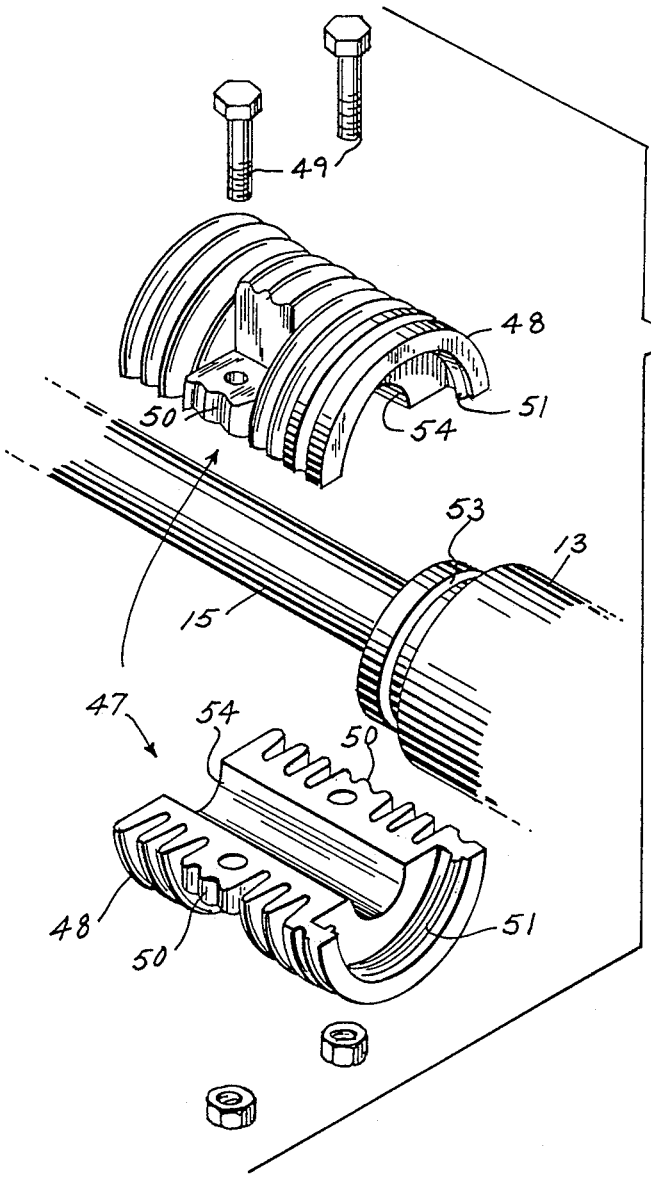
FIG. 9
FIG. 11
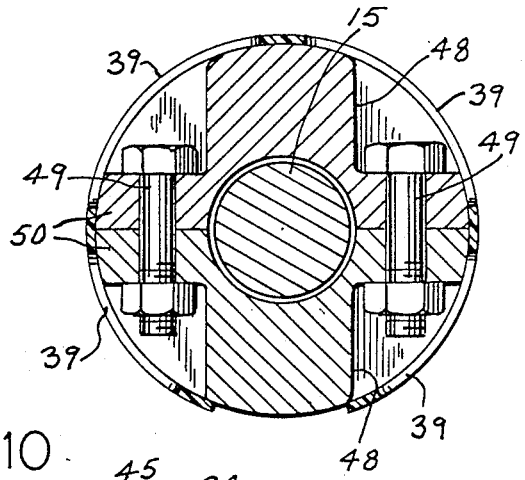
FIG. 10
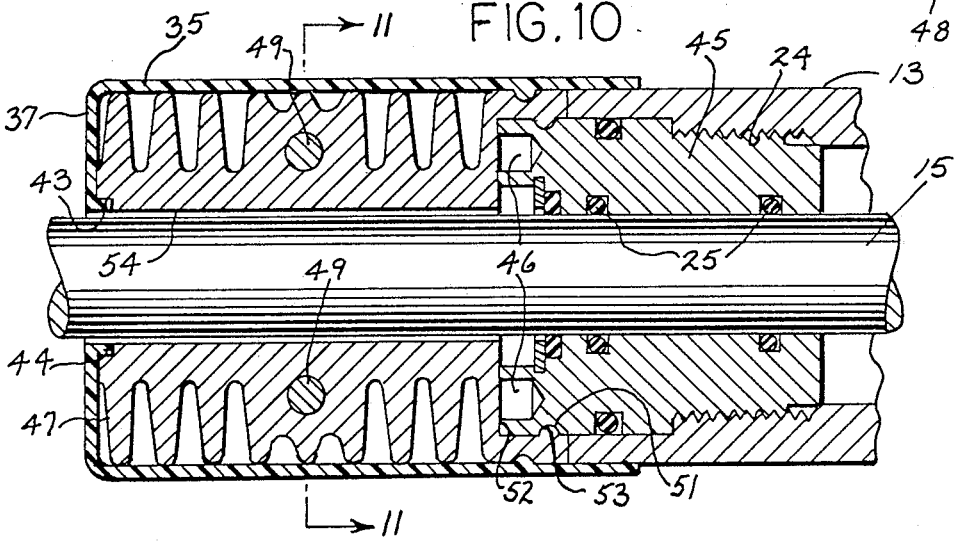

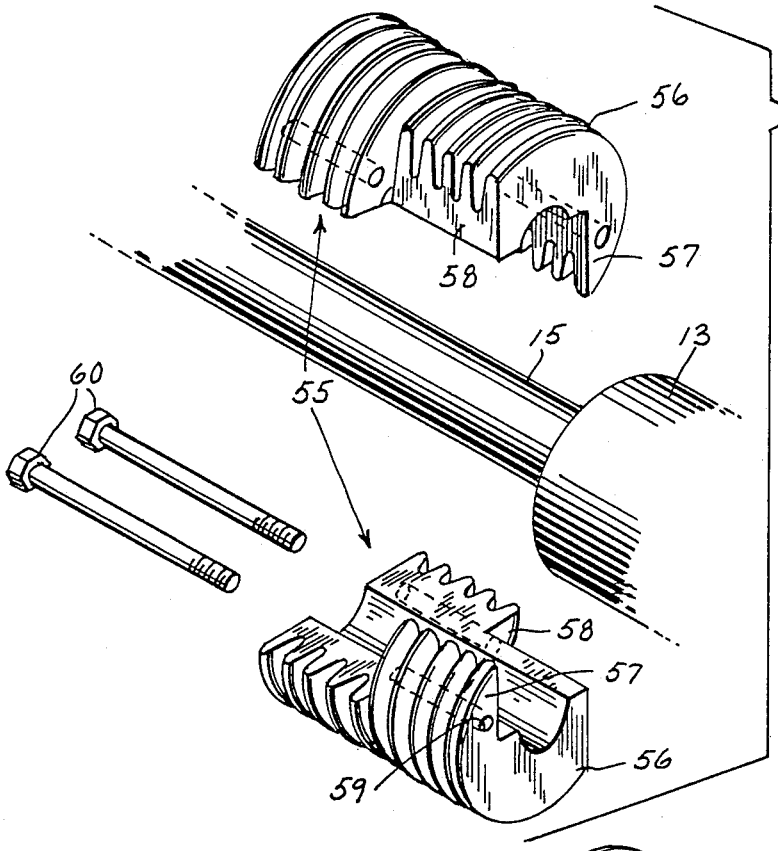
FIG. 12
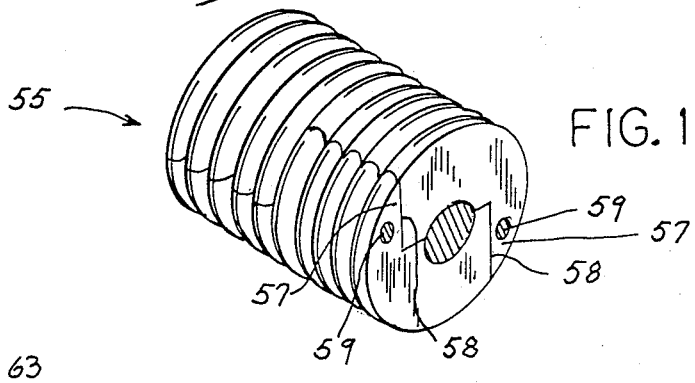
FIG. 13
FIG. 14
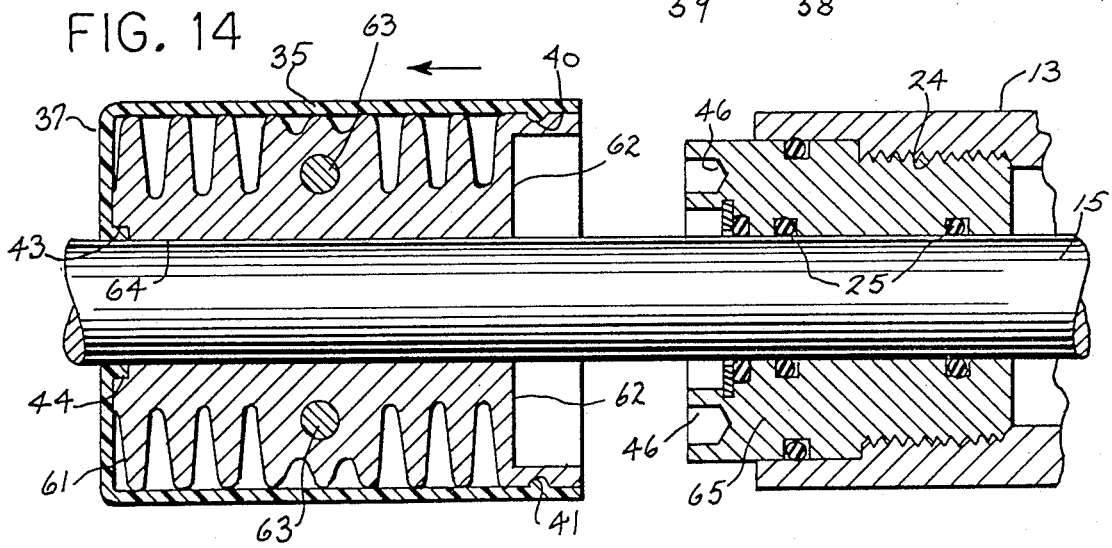

SACRIFICIAL ANODE FOR MARINE PROPULSION UNITS

BACKGROUND AND SUMMARY OF THE INVENTION

This invention relates to a sacrificial anode for marine propulsion units, and more particularly to the placement and construction of a sacrificial anode mounted to a marine stern drive, outboard motor, or the like for purposes of protecting the parts of the unit against corrosion.

Sacrificial anodes of zinc or the like have long been utilized in marine applications for protecting the metallic parts of aluminum or the line in marine applications. Heretofore, such anodes have been positioned in numerous places. They have often been placed on the bottom or side of a marine vehicle itself. More frequently, however, they have been positioned directly on the propulsion unit. In the past, the placement has usually been below the anti-cavitation plate in the lower area of the drive unit, and has taken the form of a so-called trim tab depending downwardly from the plate. Such placement has done little to cathodically protect the upper portion of a drive unit.

Consideration has been given to providing better protection for the upper drive shaft housing by placing a sacrificial anode above the anti-cavitation plate. Various placements have been considered, and one has been adopted forwardly of the vertical drive housing adjacent the transom, but this does not protect the rearward upper portion of the unit. Aesthetics and the inability to provide sufficient weight or surface area of the anode to be truly effective are still problems. One of the major problems has been to find adequate space for the anode adjacent the rearward portion of the upper drive shaft housing, in view of the complex and tightly crowded various structures required in that area.

It is an object of the present invention to solve the aforementioned problems, and to position a sacrificial anode adjacent the upper drive shaft housing of a marine propulsion unit, while not interfering with the other adjacent mechanisms. It is a further object to provide such an anode which is aesthetically acceptable, and which has sufficient weight and surface area to be highly effective.

The present invention is based on a unique solution to the said problems. It has been noted by the present inventor that in marine propulsion systems utilizing trim cylinders for pivotally raising and lowering the drive unit, the piston rod of the trim cylinder has extended rearwardly beyond the cylinder itself by several inches before the rod terminates in a rodeye or other member which is pivotally mounted to an aft portion of the upper portion of the drive shaft housing. The resultant space between the cylinder and rodeye has previously been unused.

Broadly in accordance with the various aspects of the invention, a sacrificial anode is disposed in association with the trim cylinder unit and is positioned in the previously unused area between the aft cylinder end and the rodeye or the like on the piston rod end. More specifically, the anode is in the form of an elongated generally cylindrical member of a diameter approximating that of the trim cylinder to provide improved mass characteristics, and is deeply grooved to thus provide ribs which enhance the working surface area. The anode may be attached to an extended pilot member which is suitably secured within the aft end of the trim cylinder. It is contemplated that a cover may be utilized in conjunction with the anode to improve the aesthetic appearance of the affected area, while permitting water flow through the anode.

In one embodiment, a unitary anode is provided with a radial slot, which permits the anode to be positioned over the trim cylinder rod. In another embodiment, the anode is formed as two half cylinders. In yet another embodiment, the anode is formed as two segments, each having staggered puzzle-like configurations which are interfit. Depending on the anode type, the anode may be secured to the pilot member by longitudinal bolts or by a rib and groove connection. Alternately, the anode may be secured directly on the trim cylinder piston rod shaft. In addition, the anode cover may be secured to the anode itself or to the trim cylinder by a snap-on arrangement.

BRIEF DESCRIPTION OF THE DRAWINGS

The accompanying drawings illustrate the best mode presently contemplated by the inventor for carrying out the invention.

In the Drawings:

FIG. 1 is a generally schematic view of a boat-mounted marine propulsion unit which incorporates the various aspects of the invention;

FIG. 2 is an exploded perspective view of a first embodiment of anode to be attached to a trim cylinder, and showing the cover as well;

FIG. 3 is a transverse section taken on line 3—3 of FIG. 1;

FIG. 4 is a longitudinal sectional view of the assembled unit, taken on line 4—4 of FIG. 3, with parts broken away;

FIG. 5 is a transverse section taken on line 5—5 of FIG. 4;

FIG. 6 is a transverse section taken on line 6—6 of FIG. 4;

FIG. 7 is a front end view of the anode cover;

FIG. 8 is an enlarged fragmentary sectional view of the anode-to-pilot joint, generally similar to a portion of FIG. 4 but with the bolt removed, and also showing a different securement for the cover;

FIG. 9 is an exploded view generally similar to FIG. 2, but of another embodiment of anode;

FIG. 10 is a longitudinal section, generally similar to FIG. 4, of the assembled unit of FIG. 9;

FIG. 11 is a transverse section taken on line 11—11 of FIG. 10;

FIg. 12 is an exploded view generally similar to FIGS. 2 and 9, but in somewhat simplified form and of yet another embodiment of anode;

FIG. 13 is a perspective view of the anode of FIG. 12 with parts assembled; and FIG. 14 is a longitudinal section, generally similar to FIGS. 4 and 10, and illustrating another arrangment for securement of an anode.

DESCRIPTION OF THE PREFERRED EMBODIMENTS

FIG. 1 of the drawings illustrates the present invention as applied to a marine stern drive unit, although the inventive aspects are equally applicable to other marine propulsion units, such as outboard motors. As shown herein, stern drive unit 1 is adapted to be suitably mounted, as by a mounting bracket 2, to the transom 3 of a boat 4. An internal combustion engine 5 is disposed within the boat and includes an output shaft (not shown) which extends through transom 3 to unit 1 in the usual manner.

Stern drive unit 1 generally includes a drive shaft housing 6 having an upper housing portion 7 and a lower housing portion 8 suitably mounted to portion 7. An anti-cavitation plate 9 is positioned about midway of the height of housing 6. Furthermore, a generally horizontal torpedo housing 10 is disposed at the bottom of housing 6, and carries the usual propeller 11 which is driven from engine 5. In addition, a pair of normally generally horizontal trim cylinder units 12 (only one being shown) are disposed above plate 9 and adjacent upper housing portion 7. Trim cylinder units 12 generally comprise a trim cylinder 13 mounted for pivoting movement at its forward end on a gimbal ring (not shown) which in turn is mounted to transom bracket 2, as at 14. A piston (not shown) is disposed within cylinder 13 and is provided with a piston rod 15 which extends rearwardly for several inches from the aft end of the cylinder, where it terminates in a rodeye 16 or the like which is pivotally mounted to an aft portion of upper housing portion 7 of housing 6, as at 17. Trim cylinder units 12 are actuated by the vehicle operator in any well-known manner to pivot the housing 6 and associated parts relative to the boat and water line.

Broadly in accordance with the inventive aspects, a cathodically protective sacrificial anode assembly 18 is disposed on trim cylinder unit 12 and is mounted on and essentailly envelopes, in a partially surrounding relationship, piston rod 15 between the aft end of cylinder 13 and the rodeye end of the piston rod at pivotal mount 17.

Referring now to FIGS. 2 through 8, anode assembly 18 includes a unitary elongated generally cylindrical anode 19 of zinc or other suitable metal which has an outer diameter approximating that of trim cylinder 13. The body of anode 19 is provided with a core portion 20 and a plurality of axially spaced circumferential deep grooves 21 (See the lower portion of FIG. 4) which form a plurality of axially spaced circumferential radial sacrificial ribs 22 of major radial extent. The construction provides an anode of excellent weight and surface area characteristics.

Heretofore, a cylinder end cap nut was threaded into the aft end of the trim cylinder to close the latter. In previous devices, the cap nut was of very short axial extent and almost disc-like and had circumferentially spaced spanner holes for receipt of a spanner wrench for manipulating the nut.

The aspects of the present invention contemplate, in the present embodiment, mounting anode 19 to trim cylinder 13 via a cylinder cap nut 23 which is threaded within the aft cylinder end, as at 24, but which is of greater axial extent than previous nuts to thereby provide more adequate bearing support, and which extends rearwardly of the cylinder. See FIG. 4. Suitable annular seals 25 are disposed between cap nut 23 and cylinder 13 and piston rod 15. A plurality of circumferentially spaced spanner holes 26 (four in number) are mounted in the aft face of cap nut 23, but in this instance, the inner ends of at least some of holes 26 merge into threaded bores 27 (two in number) of reduced diameter. See especially FIGS. 4–6 and 8. Cap nut 23 serves as a pilot member for mounting anode 19 to trim cylinder unit 12.

For mounting purposes, the interior of the body of anode 19 is provided with a pair of generally opposed longitudinally extending bosses 28 which interrupt grooves 21 so that in the area of the bosses, the grooves are shallower and ribs 22 are of short radial extent. (See the upper portion of FIG. 4.) The aft ends of bosses 28 are recessed into the aft anode end, as at 29. A longitudinal bore 30 extends through each boss 28 and is adapted to receive a horizontal hex-head screw or bolt 31, the head of which is disposed in a recess 29 which forms a bolt-head relief. The arrangement is such that ribs 22 will corrode faster that the area of core 20 or bosses 28.

In addition, anode 19 is provided with a central axial bore 32 of the approximate diameter, but slightly larger than that of piston rod 15. A generally U-shaped enlarged slot 33 extends radially from bore 32 to the anode periphery along the longitudinal anode extent. Furthermore, the forward anode end is recessed as at 34 to fit over the slightly reduced aft end portion of cap nut 23.

To assemble anode 19 to trim cylinder unit 12, the anode is manipulated rearwardly of cylinder 13 so that it is dropped downwardly with U-shaped slot 33 sliding down over rod 15, until anode 19 seats onto the latter. Anode 19 is then slid forwardly on rod 15 until anode recess 34 receives the aft end of cap nut 23 in a seating and piloting relationship. Bolts 31 are positioned within bores 30 and then screwed into threaded bores 27 of cap nut 23.

For purposes of appearance, anode assembly 18 includes a generally cylindrical slightly flexible anode cover 35 which is generally of the same diameter as the anode and which may be made of molded plastic or the like. As best seen in FIG. 2, cover 35 is longitudinally separated along its lower portion, as at 36, to accommodate entry over piston rod 15. In addition, the aft end of cover 35 is shown as provided with an end cap (integral or otherwise) 37 which has a radial slot 38 generally conforming in shape to anode slot 33. See FIG. 7. A plurality of perforations in the form of slot segments 39 of relatively short circumferential extent are provided in the cylindrical cover body and provide for a pleasing decorative appearance, while permitting ingress of water to and through anode 19. Cover 35 is preferably assembled to anode 19 by dropping the cover down over an extended piston rod 15 rearwardly of the anode after the latter has been fastened to cap nut 23. Cover 35 may then be slid forwardly and longitudinally over the anode.

Referring primarily to FIGS. 4 and 7, cover 35 is securd at its forward end to the forward end portion of anode 19. For this purpose, a pair of opposed circumferential ribs 40 are disposed on the forward interior surface of the cover, with ribs 40 being adapted to snap into a peripheral groove 41 disposed at the forward end of anode 19. Alternately, and as best shown in FIG. 8, the ribs 40 of cover 35 may be snapped into a peripheral groove 42 disposed in the aft end portion of the body of trim cylinder 13.

For purposes of centering and stabilizing the aft end of cover 35 relative to anode 19 and piston rod 15, the anode is provided with an annular counterbore 43 which receives an annular boss 44 disposed on the cover.

A cover similar to cover 35 may be used with any of the embodiments disclosed herein.

Turning now to the embodiment shown in FIGS. 9–11, an extended cap nut 45 is secured to trim cylinder 13 similarly to the first embodiment, but in this instance, spanner holes 46 do not need threaded extensions. Furthermore, the sacrificial anode 47 is generally similar in working configuration to anode 19, but is made of two diametrically split full diameter half cylinders 48 which are half-moon in section. These separate cylinder sections are clamped over and onto the piloting cap nut 45, as by a pair of parallel diametrically opposed generally transverse bolts 49 which extend through flanges 50 formed in the anode periphery. Circumferential rib means 51 disposed within a forward recess 52 in anode 47 are adapted to be received in a peripheral groove 53 in cap nut 45 when bolts 49 are tightened to bring half cylinders 48 together. A clamp-on piloting is thus created. This construction does not require that the central anode bore 54 be in contact with piston rod 15.

In the embodiment of FIGS. 12 and 13, with some parts not shown for purposes of simplification, the sacrificial anode 55 is generally similar in working configuration to anodes 19 and 47, but is made of two staggered half pieces 56 which have male finger-like projections 57 and female recesses 58 which interlockingly fit together in a puzzle-type fit. Half pieces 56 may be indentical, but rotated and turned over to interfit. The male projections 57, which are longitudinally adjacent in the assembled unit, form bosses having bores 59 through which a pair of longitudinally extending bolts 60 pass. The mounting of anode 55 to trim cylinder unit 12 may be similar to that shown in the embodiment of FIGS. 2 through 8.

In the embodiment of FIG. 14, the sacrificial anode 61 may be constructed of two diametrically split full diameter half cylinders 62 with a pair of transverse clamping bolts 63, generally similar to anode 47 of FIGS. 9–11. However, as contrasted with the the FIG. 9–11 embodiment, anode 61 has a central bore 64 which is of a diameter very close to approximating the outer diameter of piston rod 15. Thus, clamping of half cylinders 62 together by bolts 63 causes the entire assembly to be securely tightened onto piston rod 15 itself. No connection to a cap nut would be necessary, although such a nut 65 is shown in FIG. 14.

Various modes of carrying out the invention are contemplated as being within the scope of the accompanying claims, which particularly point out and distinctly claim the subject matter regarded as the invention.

I claim:

1. In a marine propulsion unit (1) for a boat (4), the combination comprising:

(a) a generally vertical propeller carrying drive housing (6), (b) a generally horizontal longitudinal fore-to-aft extending trim cylinder unit (12) disposed adjacent said housing for pivotally raising and lowering the latter relative to the water, (c) a sacrificial anode (19, 47, 55, 61) mounted to said trim cylinder unit, (d) said trim cylinder unit (12) including:

(1) a trim cylinder (13), (2) and a piston rod (15) extending from an end of said trim cylinder, said piston rod having an outer end, (e) and mounting means (16) for attaching said outer end of said piston rod for pivoting said trim cylinder unit relative to said boat, (f) said sacrificial anode being disposed between said trim cylinder end and said mounting means.

2. The combination of claim 1 wherein said anode is generally cylindrical and at least partially surrounds said piston rod.

3. The combination of claim 2 wherein the diameter of said anode approximates the diameter of said trim cylinder (13).

4. The combination of claim 1 or 2 wherein said anode includes a plurality of longitudinally spaced grooves (21) forming sacrificial radial ribs (22).

5. The combination of claim 1 or 2 wherein said anode (47, 55) is formed in a plurality of separate sections (48, 56).

6. The combination of claim 5 wherein said sections (56) of said anode (55) are provided with interfitting male projections (57) and female recesses (58).

7. The combination of claim 2 which includes means for attachably securing said anode to said trim cylinder (13).

8. The combination of claim 7 wherein said securing means comprises:

(a) a pilot member (23) secured to said end of said trim cylinder, (b) and longitudinally extending bolt means (31) joining said anode to said pilot member.

9. The combination of claim 7:

(a) wherein said anode (47) is formed in a plurality of separate sections (48), (b) and said securing means comprises:

(1) a pilot member (45) secured to said end of said trim cylinder, (2) interlocking circumferential rib and groove means (51, 53) in said anode (47) and said trim cylinder, (3) and transversely extending bolt means (49) for clamping said separate sections together.

10. The combination of claim 2 which includes means (63) for attachable securing said anode (61) to said piston rod.

11. The combination of claim 2, 7 or 10:

(a) wherein said anode (19) includes a central bore (32) for receiving said piston rod, (b) and which includes a radial slot (33) extending from said bore to the anode periphery, said slot serving as means to receive said piston rod upon assembly of said anode to said piston rod.

12. The combination of claim 2 which includes a generally cylindrical cover (35) disposed over said anode.

13. The combination of claim 12 wherein said cover is provided with perforation means (39) for providing ingress of water to said anode.

14. The combination of claim 12 which includes means (40, 41) for securing said cover to said anode.

15. The combination of claim 12 which includes means (40, 42) for securing said cover to said trim cylinder (13).

16. The combination of claim 12 which includes:

(a) an annular counterbore (43) disposed in the outer end of said anode, (b) and an annular boss (44) on said cover and received within said counterbore, (c) said counterbore and said boss surrounding said piston rod.

* * * * *

UNITED STATES PATENT AND TRADEMARK OFFICE

CERTIFICATE OF CORRECTION

PATENT NO. : 4,872,860

DATED : October 10, 1989

INVENTOR(S) : Gary L. Meisenburg

It is certified that error appears in the above-identified patent and that said Letters Patent is hereby corrected as shown below: Title page:

In the Abstract, line 21, delete "anothr" and substitute therefor --another--.

In the Abstract, line 30, delete "snal-on" and substitute therefor --snap-on--.

Column 2, line 52, delete "FIg." and substitute therefor --FIG.--.

Column 4, line 50, delete "securd" and substitute therefor --secured--.

Column 6, claim 10, line 39, after "for" delete "attachable" and substitute therefor --attachably--.

Signed and Sealed this

Thirtieth Day of October, 1990

*Attest:*

HARRY F. MANBECK, JR.

*Attesting Officer*

*Commissioner of Patents and Trademarks*